United States Patent [19]

Pere

[11] 4,342,544

[45] Aug. 3, 1982

[54] RECIPROCATING PUMP

[75] Inventor: Gerard Pere, Le Breuil, France

[73] Assignee: Creusot-Loire, Paris, France

[21] Appl. No.: 135,852

[22] Filed: Mar. 28, 1980

[30] Foreign Application Priority Data

Mar. 30, 1979 [FR] France ..... 79 08006

[51] Int. Cl.[3] ..... F04B 1/18

[52] U.S. Cl. ..... 417/269

[58] Field of Search ..... 417/269–273

[56] References Cited

U.S. PATENT DOCUMENTS

| | | | |
|---|---|---|---|
| 2,400,119 | 5/1946 | Joy | 417/269 |
| 3,292,554 | 12/1966 | Hessler | 417/269 |
| 3,411,453 | 11/1968 | Chanal | 417/269 |
| 3,958,901 | 5/1976 | Prevet | 417/269 |
| 4,105,369 | 8/1978 | McClocklin | 417/269 |

FOREIGN PATENT DOCUMENTS

| | | | |
|---|---|---|---|
| 921246 | 11/1954 | Fed. Rep. of Germany | 417/269 |
| 860429 | 1/1941 | France | 417/269 |
| 1007900 | 5/1952 | France | 417/269 |
| 1007901 | 5/1952 | France | 417/269 |

*Primary Examiner*—William L. Freeh

[57] ABSTRACT

A reciprocating pump comprising several pumping volumes formed by cylinders fixed to a frame in an axial piston arrangement, and by pistons capable of sliding in the cylinders under the action of a driving mechanism, and including a ducting assembly conveying the liquid to be displaced from a general intake conduit to the pumping volumes, through intake valves, and from the pumping volumes to a general delivery conduit, through delivery valves. The ducting assembly comprises both a central cylinder head through which passes a central distribution channel connected to the general intake conduit and supplying off-take passages which radiate around it to the side bearing surfaces, and side cylinder heads through which run passages conveying the liquid.

5 Claims, 2 Drawing Figures

RECIPROCATING PUMP

FIELD OF THE INVENTION

The present invention concerns a reciprocating pump comprising several liquid-pumping chambers formed by cylinders and pistons in what is termed an axial piston arrangement.

The present invention has particular application to pumps for pumping sludge.

BACKGROUND

There are known pumps comprising several pumping chambers each formed of a cylinder and a piston or diaphragm moving in the bore of this cylinder. In some pumps, the cylinders are affixed to the frame in what is termed an "axial piston" arrangement, the pistons being displaced along the generating lines of an imaginary cylinder. These pistons are solid with rods which are articulated to connecting rods themselves articulated to a plate inclined with respect to the longitudinal axis of the pump. The inclined plate is moved with a nutational movement by a driving mechanism.

The flow of the liquid, upstream and downstream of each pumping chamber, is controlled by valves assuring a single-acting operation. An intake valve is positioned upstream of a pumping chamber so as to open under the effect of the lowering of pressure created by the induction stroke of the piston. A delivery valve is positioned downstream of each pumping chamber so as to open on the delivery stroke of the piston, the intake valve then being closed.

The liquid-pumping chambers are connected to a common intake pipe via conduit, the flow of the liquid being controlled by the intake valves. The pumping chambers are also connected by conduits to a common delivery pipe, the flow of the liquid being controlled by the delivery valves.

It is necessary to remove the lines previously mentioned when the valves and valve seatings have to be changed. These elements have a relatively short life and it must be possible to replace them rapidly and easily.

The object of the present invention is to limit the disadvantages associated, in known pumps, with the conduits which serve to convey the liquid to the pumping chambers and from these chambers to the common exhaust pipe. The object of the invention is a pump of the axial piston type in which the use of conduits, upstream and downstream of the pumping chambers, for conveying the liquid to be displaced is avoided. The liquid to be displaced is conveyed to short passages, between the general intake line and the chambers and between these chambers and the general delivery line. This results in an equal distribution of the liquid to be displaced in the passages, and in some cases allows the charging pump to be omitted. The risks of cavitation, due to fluctuations in pressure, can also be reduced. Maintenance is easy, thanks to the use of easily removed cylinder heads through which run passages conveying the liquid to be displaced, and which are equipped with valves. The pump according to the invention takes up less space than those known in the art.

SUMMARY OF THE INVENTION

The pump according to the invention comprises several pumping chambers formed by cylinders fixed to a frame in an axial piston arrangement and by pistons capable of sliding in the said cylinders under the action of a driving mechanism, and includes a ducting assembly conveying the liquid to be displaced from a general intake line to the pumping chambers, through intake valves, and from the said pumping chambers to a general delivery line, through delivery valves. It is essentially characterized by the fact that this ducting assembly comprises both (a) a central cylinder head through which passes a central distribution channel connected to the general intake line and supplying off-take passages which radiate around it to side bearing surfaces, and (b) side cylinder heads through which run passages conveying the liquid from upstream of a said intake valve to downstream of a said delivery valve. Each of these cylinder heads bears against a side bearing surface of the central cylinder head and against the frame, so that one of its passages extends an off-take passage of the said central cylinder head and another of its passages communicates with a pumping chamber.

The invention will now be described in more detail with reference to an embodiment given by way of example and represented by the attached drawings.

DETAILED DESCRIPTION

Figure 1:
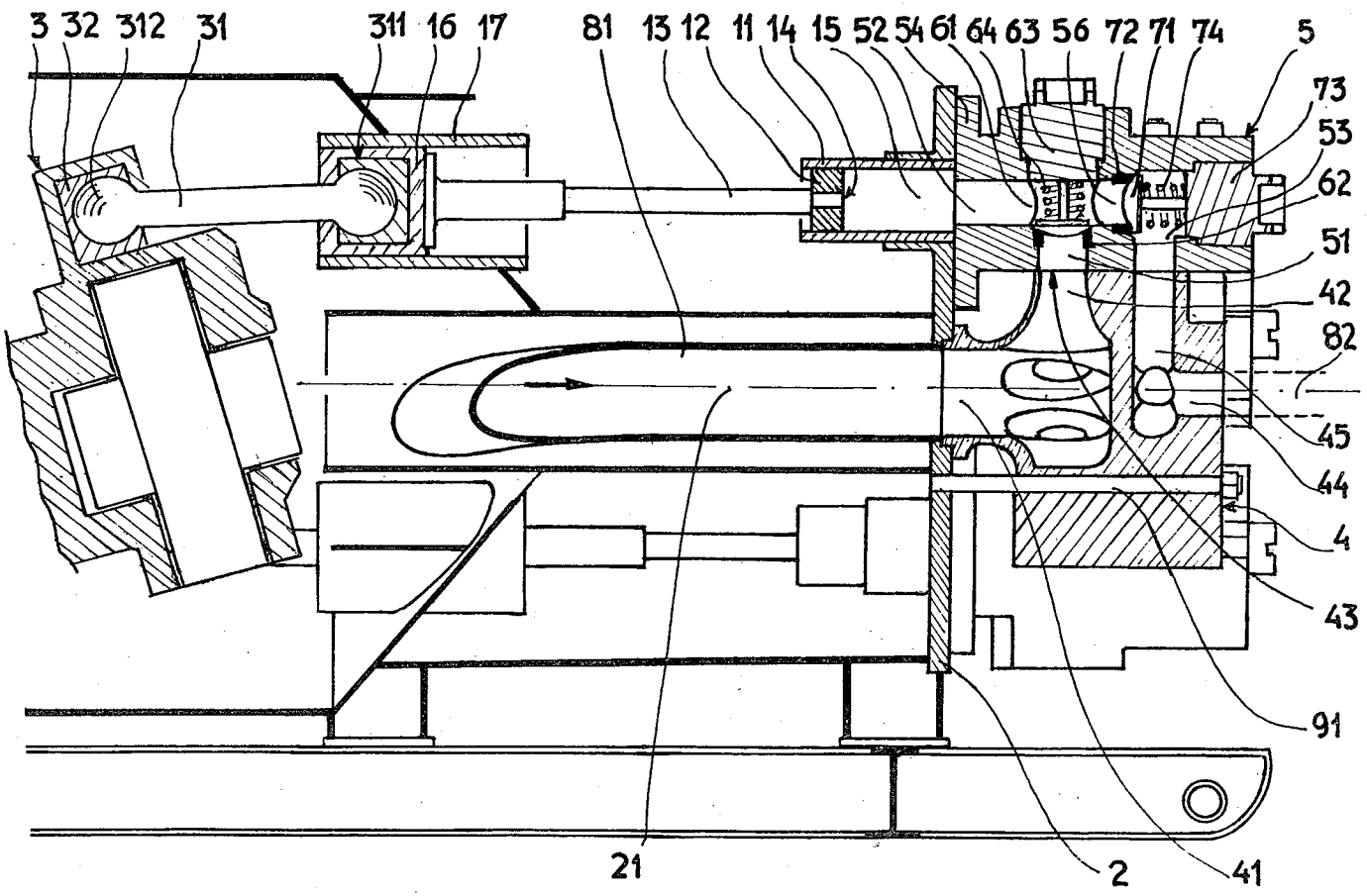
FIG. 1 is a longitudinal section of the pump according to the invention.
Figure 2:
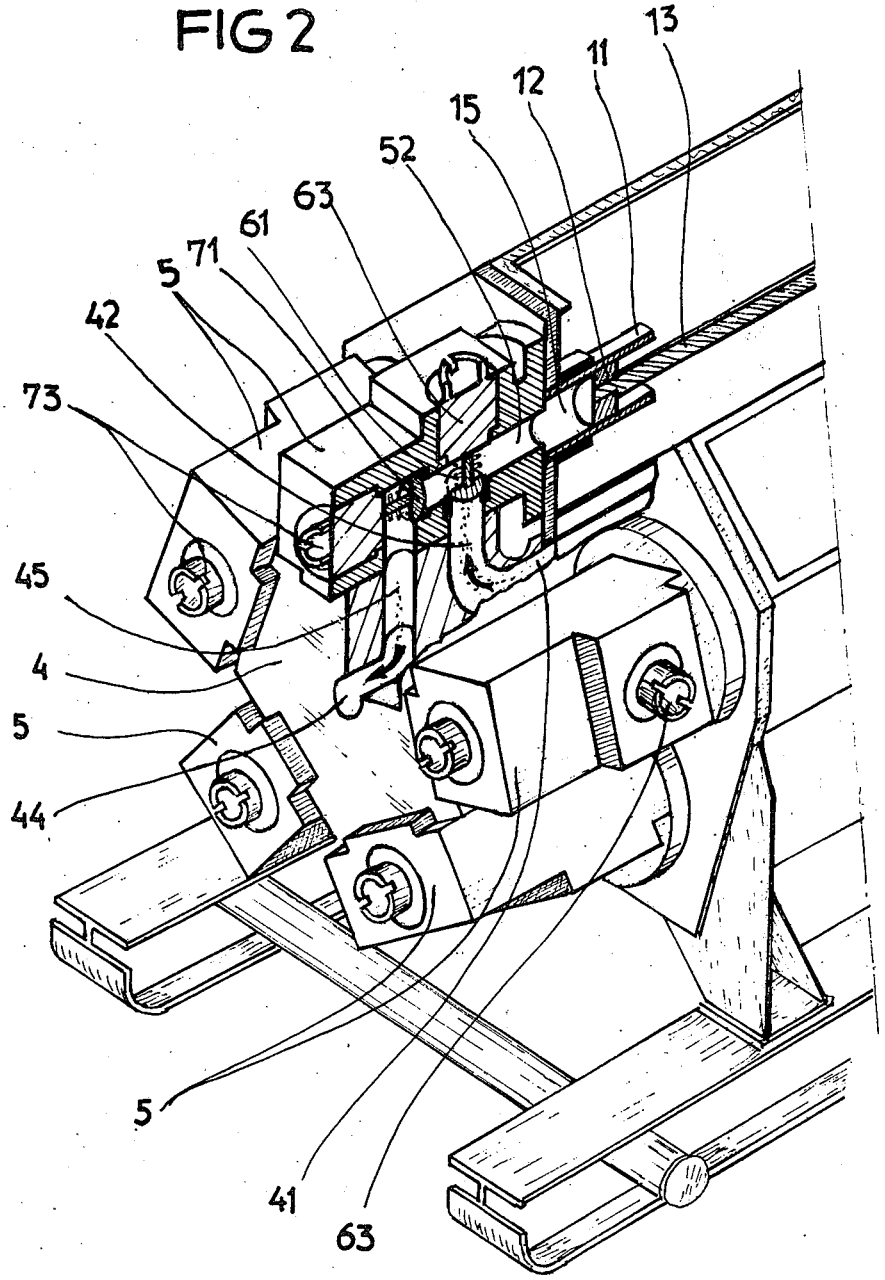
FIG. 2 is a perspective view of one part of the pump represented in FIG. 1.

With reference to FIGS. 1 and 2, the pump comprises a group of cylinders 11 which are fixed on a frame 2 in what is termed an axial piston arrangement, the axes of these cylinders being the generating lines of an imaginary cylinder whose axis is marked 21. A piston 12 is engaged in each cylinder. This piston is provided with a sealing ring which assures sealing with the bore of the cylinder. This piston and this cylinder together form, on one side of the active face 14 of the piston, a pumping chamber 15 which contains the liquid to be displaced. Each piston is solid with a piston rod 13 which is connected, possibly by couplings, to a slide 16 guided in a jacket 17 solid with the frame. Each slide 16 is connected to a connecting rod 31 by a ball-and-socket joint 311. This connecting rod is connected by a ball-and-socket joint 312 to a plate 32 forming part of a driving mechanism 3 known per se. The plate 32 is inclined to the axis 21 so that the joints of the connecting rods are contained in an inclined plane with respect to the axis 21. Plate 32 is moved with a nutational movement about axis 21 by the driving mechanism. A driving mechanism of this type for reciprocating displacement of the pistons 12 is described, for example, in French Patent Nos. 2.211.090 and 2.271.459.

The liquid to be displaced enters the pump through a general intake conduit 81 and leaves through a general delivery conduit 82. These two conduits are coaxial with the axis 21.

The liquid to be displaced is conveyed, between the conduits 81 and 82, in a central cylinder head 4 and in side cylinder heads 5. The central cylinder head 4 is fixed to the frame by tie rods 91. The side cylinder heads 5 are applied by flat bearing surfaces against flat bearing surfaces 43 of the central cylinder head, these bearing surfaces being parallel to the axis 21. The side cylinder heads are also applied by flanges 54 against frame 2.

The central cylinder head has a distribution channel 41 which is connected coaxially to the general intake conduit 81. This channel 41 supplies off-take passages 42 which radiate all around the axis 21 so that the outlets at the level of the bearing surfaces 43 are located in a plane perpendicular to this axis 21. In these passages 42, the liquid flows from the center outwards, in accordance with the direction of the arrows.

In each side cylinder head 5, the liquid to be displaced flows under the control of an intake valve 61 and a delivery valve 71. The intake valve 61 is associated with a seat 62 against which it is biased by a spring 64. The valve 61 moves along an axis perpendicular to the axis 21. The assembly can be removed by way of a plug 63 which is screwed in the body of the side cylinder head. The delivery valve 71 is associated with a seat 72 against which it is biased by a spring 74. The delivery valve moves along an axis parallel to the axis 21. The assembly of members associated with the delivery valve can be removed by way of a plug 73 screwed in the body of the side cylinder head.

Each side cylinder head has, upstream of the seat 62 associated with the intake valve, a radial channel 51 which acts as an extension of an off-take passage 42 of the central cylinder head. Sealing between the passages 42 and 51 is assured by seals. This radial passage communicates downstream of the valve 61 with a pumping chamber 15 via a passage 52 which is parallel to the axis 21. This passage 52 communicates with a chamber 56 between the intake valve 61 and the delivery valve 71. The flow of liquid, downstream of the chamber 56, is controlled by the delivery valve 71. Downstream of this valve 71, the liquid is conveyed in a radial delivery passage 53.

The central cylinder head has collector passages 45 running radially through it which open into a collector channel 44. This channel 44 is connected axially to the general delivery line 82. Each collector passage 45 is connected to a radial delivery passage 53 of a side cylinder head. At the level of the side bearing surfaces, sealing between the passages 45 and 53 is assured by seals.

On each side cylinder head, the axis of displacement of the intake valve 61 is perpendicular to the axis 21, while the axis of displacement of the delivery valve 71 is parallel to the axis 21. The central cylinder head 4 and the side cylinder heads can be obtained by molding. The central cylinder head 4 can be made in two parts, if necessary.

The working of the pump illustrated by FIGS. 1 and 2 will now be described.

The pistons 12 are moved in a reciprocating movement which takes in and delivers the liquid entering through general intake conduit 81. In the intake phase, the intake valve 61 of a side cylinder head 5 rises under the effect of the lowering of pressure created by the intake stroke of the piston associated with this cylinder head. A quantity of liquid coming from the off-take channel 42 is then admitted to the pumping chamber 15. In the delivery phase, the intake valve 61 is applied against the associated seat 62. The delivery valve 71 moves away from the associated seat so as to allow liquid to flow into the delivery channels 53 and 45. Because the pistons 12 are staggered along the axis 21 of the pump, there is a relatively regular flow of liquid into the general delivery conduit 82 at this stage.

What is claimed is:

1. A pump for liquid comprising:

(a) a plurality of pumping chambers formed by cylinders fixed to a support structure in a barrel type arrangement and by pistons slidable in said cylinders under the action of drive means;

(b) a central cylinder head having (i) a central distribution channel;

(ii) a plurality of conduits diverging radially from said central distribution channel; and (iii) a plurality of collector conduits opening into a collector passage connected to a general discharge conduit;

(c) a plurality of lateral cylinder heads arranged radially about said central cylinder head, each of said lateral cylinder heads being sealingly in abutment against a surface of said central cylinder head;

(d) intake valves and discharge valves mounted on each of said lateral cylinder heads;

(e) conduits in said lateral cylinder heads communicating with said radial conduits and with said pumping chambers;

(f) whereby said liquid is carried from a general intake pipe through said central distribution channel and said radial conduits which communicate downstream of said intake valves with said pumping chambers, said discharge valves being located downstream of said pumping chambers to control the flow of said liquid carried by said collector conduits.

2. A pump according to claim 1, wherein said central cylinder head is delimited by flat bearing surfaces parallel to the axis of said pump.

3. A pump according to claim 1, wherein said lateral cylinder heads are applied against said support structure.

4. A pump according to claim 1, wherein said central distribution channel and said discharge collector channel are disposed along the axis of said pump.

5. A pump according to any one of claims 1 to 4, wherein said intake valves are disposed for movement perpendicular to the axis of said pump and said discharge valves are disposed for movement parallel to the axis of said pump.

* * * * *